US007745717B2

(12) United States Patent
Sasaki et al.

(10) Patent No.: US 7,745,717 B2
(45) Date of Patent: Jun. 29, 2010

(54) WEARABLE ELECTRONIC DEVICE

(75) Inventors: Michihiko Sasaki, Hamamatsu (JP); Toru Nishinotsuji, Hamamatsu (JP)

(73) Assignee: Yamaha Corporation (JP)

( * ) Notice: Subject to any disclaimer, the term of this patent is extended or adjusted under 35 U.S.C. 154(b) by 8 days.

(21) Appl. No.: 12/049,347

(22) Filed: Mar. 16, 2008

(65) Prior Publication Data

US 2008/0223198 A1 Sep. 18, 2008

(30) Foreign Application Priority Data

Mar. 16, 2007 (JP) ..... 2007-068951

(51) Int. Cl.
*G10H 1/00* (2006.01)

(52) U.S. Cl. ..... 84/615; 84/653; 200/335; 200/339; 200/42.01

(58) Field of Classification Search ..... 84/600–602, 84/615, 653; 200/335, 336, 339, 401, 42.01
See application file for complete search history.

(56) References Cited

U.S. PATENT DOCUMENTS

| | | | | |
|---|---|---|---|---|
| 5,088,070 | A * | 2/1992 | Shiff | 368/10 |
| 5,444,673 | A * | 8/1995 | Mathurin | 368/63 |
| 5,813,026 | A * | 9/1998 | Borg et al. | 711/115 |
| 5,870,710 | A | 2/1999 | Ozawa et al. | |
| 5,999,494 | A * | 12/1999 | Holzrichter | 368/63 |
| 6,144,619 | A * | 11/2000 | Reisman | 368/10 |
| 6,527,610 | B1 * | 3/2003 | Hornsby et al. | 446/175 |
| 6,560,165 | B1 * | 5/2003 | Barker | 368/10 |
| 6,977,868 | B2 * | 12/2005 | Brewer et al. | 368/46 |
| 7,193,606 | B2 * | 3/2007 | Barnett et al. | 345/156 |
| 7,215,319 | B2 * | 5/2007 | Kamijo et al. | 345/156 |
| 2001/0004397 | A1 * | 6/2001 | Kita et al. | 381/334 |
| 2001/0024404 | A1 * | 9/2001 | Ito | 368/10 |

(Continued)

FOREIGN PATENT DOCUMENTS

| | | |
|---|---|---|
| JP | 3063454 U | 8/1999 |

(Continued)

OTHER PUBLICATIONS

Reasons for Rejection issued in corresponding Japanese Patent Application No. 2007-068951 dated Feb. 27, 2009.

(Continued)

*Primary Examiner*—David S. Warren
(74) *Attorney, Agent, or Firm*—Rossi, Kimms & McDowell LLP

(57) ABSTRACT

In a wearable electronic device attachable to an arm, a display screen is disposed on a top face of a main body which is attached to the arm. First and second controls are arranged adjacent to opposite sides of the display screen, respectively, and project obliquely from the top face of the main body. The first control is configured to move toward a near side of the display screen by an operation of the user and to return spontaneously to a rest position away from the near side. The second control is configured to move toward a near side of the display screen by an operation of the user and to return spontaneously to a rest position away from the near side. An operation of one of the first and second controls or both of the first and second controls enables setting of the device using the display screen.

11 Claims, 9 Drawing Sheets

U.S. PATENT DOCUMENTS

| | | | | |
|---|---|---|---|---|
| 2002/0027547 | A1* | 3/2002 | Kamijo et al. | 345/157 |
| 2002/0097158 | A1* | 7/2002 | Muto et al. | 340/573.1 |
| 2002/0186621 | A1* | 12/2002 | Lai | 368/82 |
| 2003/0025670 | A1* | 2/2003 | Barnett et al. | 345/157 |
| 2003/0064757 | A1 | 4/2003 | Yamadera et al. | |
| 2003/0151982 | A1* | 8/2003 | Brewer et al. | 368/46 |
| 2004/0022130 | A1* | 2/2004 | Chung | 368/10 |
| 2004/0081025 | A1* | 4/2004 | Chen | 368/10 |
| 2004/0190380 | A1* | 9/2004 | Wojcieszak | 368/69 |
| 2004/0190383 | A1* | 9/2004 | Marcucelli et al. | 368/278 |
| 2004/0224638 | A1 | 11/2004 | Fadell et al. | |
| 2004/0233790 | A1* | 11/2004 | Narayanaswami | 368/69 |
| 2005/0013197 | A1* | 1/2005 | Chung et al. | 368/10 |
| 2006/0139150 | A1* | 6/2006 | Brue | 340/309.16 |
| 2006/0209012 | A1* | 9/2006 | Hagood | 345/109 |
| 2006/0217825 | A1 | 9/2006 | Takeda et al. | |
| 2006/0262090 | A1* | 11/2006 | Higginson | 345/161 |
| 2006/0280037 | A1* | 12/2006 | Houlon et al. | 368/110 |
| 2007/0071256 | A1 | 3/2007 | Ito | |
| 2008/0174554 | A1* | 7/2008 | Zhao | 345/163 |
| 2009/0037623 | A1* | 2/2009 | Ghassabian | 710/67 |

FOREIGN PATENT DOCUMENTS

| | | | |
|---|---|---|---|
| JP | 2001-160850 | A | 6/2001 |
| JP | 2001-221873 | A | 8/2001 |
| JP | 2002-073270 | A | 3/2002 |
| JP | 2003-108280 | A | 4/2003 |
| JP | 2003-150288 | A | 5/2003 |
| JP | 2003-345458 | A | 12/2003 |
| JP | 2006-333058 | A | 12/2006 |
| JP | 2007-65493 | A | 3/2007 |
| WO | 2006043776 | A1 | 4/2006 |

OTHER PUBLICATIONS

Notification of Reasons for Rejection, issued on Nov. 18, 2008, in corresponding application JP2007-068951.

* cited by examiner

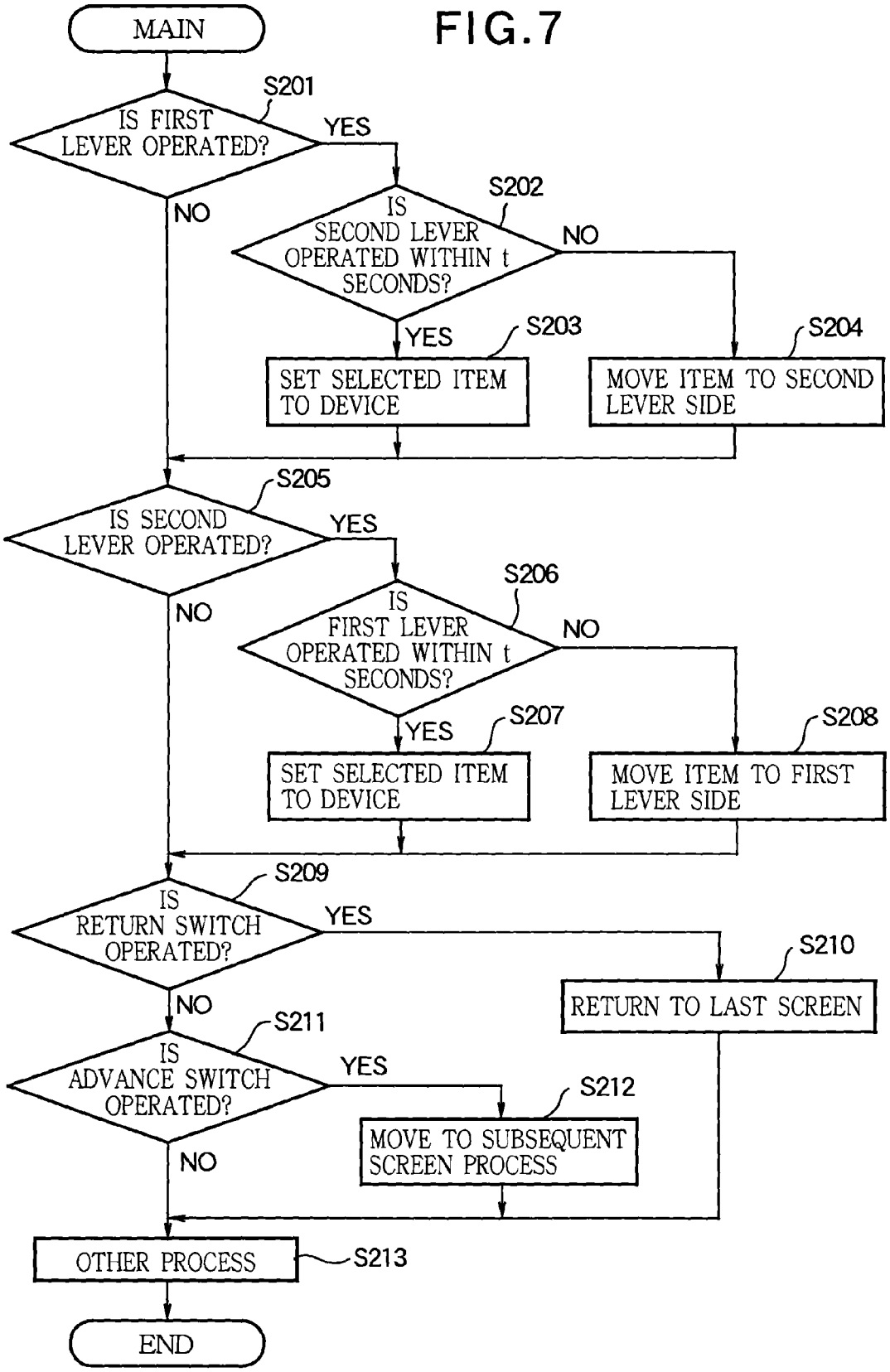
FIG.7
MAIN
S201
IS FIRST LEVER OPERATED?
YES
NO
S202
IS SECOND LEVER OPERATED WITHIN t SECONDS?
NO
YES
S203
SET SELECTED ITEM TO DEVICE
S204
MOVE ITEM TO SECOND LEVER SIDE
S205
IS SECOND LEVER OPERATED?
YES
NO
S206
IS FIRST LEVER OPERATED WITHIN t SECONDS?
NO
YES
S207
SET SELECTED ITEM TO DEVICE
S208
MOVE ITEM TO FIRST LEVER SIDE
S209
IS RETURN SWITCH OPERATED?
YES
S210
RETURN TO LAST SCREEN
NO
S211
IS ADVANCE SWITCH OPERATED?
YES
S212
MOVE TO SUBSEQUENT SCREEN PROCESS
NO
OTHER PROCESS
S213
END

WEARABLE ELECTRONIC DEVICE

BACKGROUND OF THE INVENTION

1. Technical Field

The present invention relates to a wearable electronic device, such as a music playing device, etc., which is body-worn.

2. Background Art

Conventionally, it is known a wearable electronic device, such as a music playing device, etc., which is attached to a body of a user. In a device disclosed in JP-A-2001-160850, for example, a main body of an electronic device configured as a mobile telephone is attachable to a wrist using a band. The electronic device main body is provided with a display, and a large number of various controls as well.

However, in the device disclosed in JP-A-2001-160850, a large number of controls are provided near a display portion. However, all of these controls are of press-down type, small in size, and large in numbers, and thus, the operation of these controls is complicated. In particular, when operated in a state where the device is attached to a wrist, good visual confirmation is required for a target control to be pressed down. Otherwise, an improper operation results. This arises a problem of poor functionality and operability of the device.

SUMMARY OF THE INVENTION

The present invention has been achieved to solve a problem inherent in the conventional art, and an object thereof is to provide an apparatus capable of facilitating setting operation, and particularly to provide an apparatus of wearable type capable of facilitating setting operation using a screen display.

To achieve the above-described object, an apparatus of the present invention comprises: a main body; and first and second controls that project from a face of the main body, wherein the first control projects from the face at a first direction of inclination, and the second control projects from the face at a second direction of inclination. Preferably, the main body is attachable to an arm of a user. Preferably, the apparatus further comprises a display screen that is disposed on the face of the main body, wherein the first control is arranged adjacent to a first side of the display screen, and the second control is arranged adjacent to a second side of the display screen which is opposite to the first side. Preferably, the first control is configured to move toward the first side of the display screen by an operation of the user and to return to a rest position away from the first side, and the second control is configured to move toward the second side of the display screen by an operation of the user and to return to a rest position away from the second side. An operation of one of the first and second controls or both of the first and second controls enables setting of the apparatus using the display screen.

According to the present invention, it is possible to facilitate the setting operation using controls, and particularly to facilitate the setting operation using controls and a screen display.

BRIEF DESCRIPTION OF THE DRAWINGS

FIG. 1(*b*) shows a functional configuration of a music playing device.

FIG. 4(*b*) is a cross-sectional view taken along the line A to A of the FIG. 4(*a*).

FIG. 7 is a flowchart of a control corresponding process executed at step S103 in FIG. 6.

DETAILED DESCRIPTION OF THE INVENTION

Hereinafter, with reference to drawings, an embodiment of the present invention is described.

Figure 1:
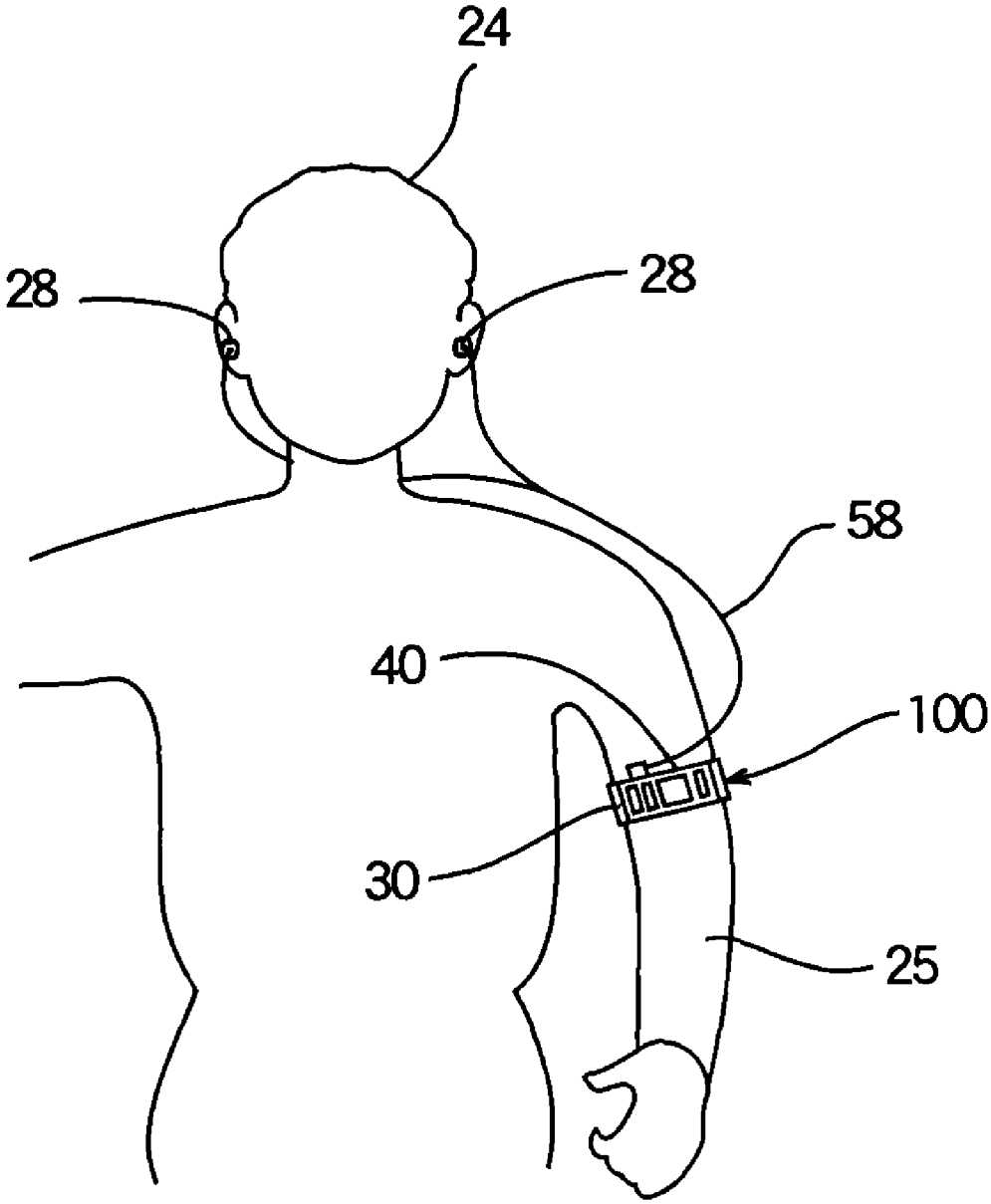
FIG. 1(*a*) shows a state where a wearable electronic device according to one embodiment of the present invention is attached to an arm of a user.
Figure 1:
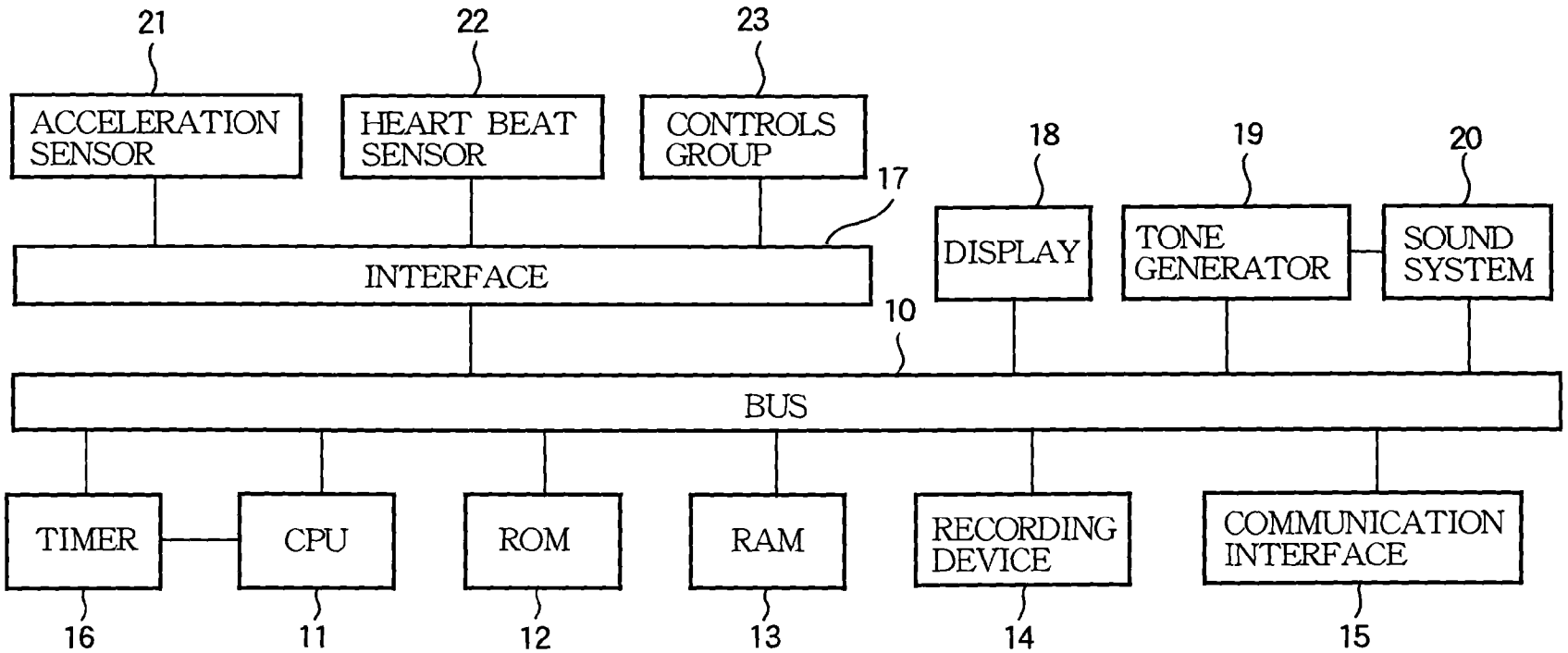

FIG. 1(*a*) is a diagram showing a state where a wearable electronic device according to one embodiment of the present invention is attached to an arm of a user. The wearable electronic device 100 is configured as a music playing device which combines a healthcare and fitness function and a music listening function, for example, but is not limited thereto. The wearable electronic device 100 is applied to various types of body-wearable electronic appliances. As shown in FIG. 1(*a*), the wearable electronic device 100 is configured by: a music playing device 40; and an attaching belt 30 for attaching the music playing device 40 to an arm 25 of a user 24 while supporting the music playing device 40.

FIG. 1(*b*) is a block diagram showing a functional configuration of the music playing device 40. As shown in FIG. 1(*b*), the music playing device 40 is configured such that a ROM 12; a RAM 13; a recording device 14; a timer 16; a communication interface 15; a display 18; a tone generator 19; a sound system 20; and an interface 17 are each connected via a bus 10 to a CPU 11. The interface 17 is further connected with: an acceleration sensor 21; a heart beat sensor 22; and a controls group 23 including a plurality of switches for inputting various pieces of information. The sound system 20 is connected also to the tone generator 19. The timer 16 is connected also to the CPU 11.

The communication interface 15 includes a MIDI (Musical Instrument Digital Interface) interface, a USB (Universal Serial Bus), or the like. When the communication interface 15 is used to connect to other devices such as a personal computer, it becomes possible to exchange information. For example, through the communication interface 15, it is possible to obtain music data.

The recording device 14 is configured of a nonvolatile memory such as a flash memory, a hard disk, or the like. The recording device 14 can store various programs, the obtained music data, setting information of the music playing device 40, various data and management data when using a fitness facility, or the like. The music data is compressed audio data such as MP3 (MPEG audio layer 3), but is not limited thereto. The music data may be Wav data and MIDI data, for example.

The acceleration sensor 21 detects acceleration applied to the music playing device 40. The detected acceleration permits monitoring of walking condition of the user, and thereby, the number of steps of walking can be counted. The heart beat sensor 22 is attached to an earlobe, or the like, of the user 24 to detect a pulse. A detection signal of the acceleration sensor 21 and that of the heart beat sensor 22 are inputted via the interface 17 to the CPU 11, and stored in the recording device 14. Also a signal indicating an operation state of the controls group 23 is inputted via the interface 17 to the CPU 11.

The CPU 11 controls the music playing device 40. The ROM 12 stores a control program executed by the CPU 11, various table data, or the like. The RAM 13 temporarily stores: various input information such as musical performance data, text data, or the like; various flags; buffer data; a calculation result, or the like. The timer 16 counts various times such as an interruption time, or the like, in a timer interrupt process. The tone generator 19 converts the musical performance data or the like into a tone signal according to an instruction of the CPU 11. The sound system 20 is configured to include an amplifier or the like, and converts the tone signal inputted from the tone generator 19 into music sounds.

Figure 2:
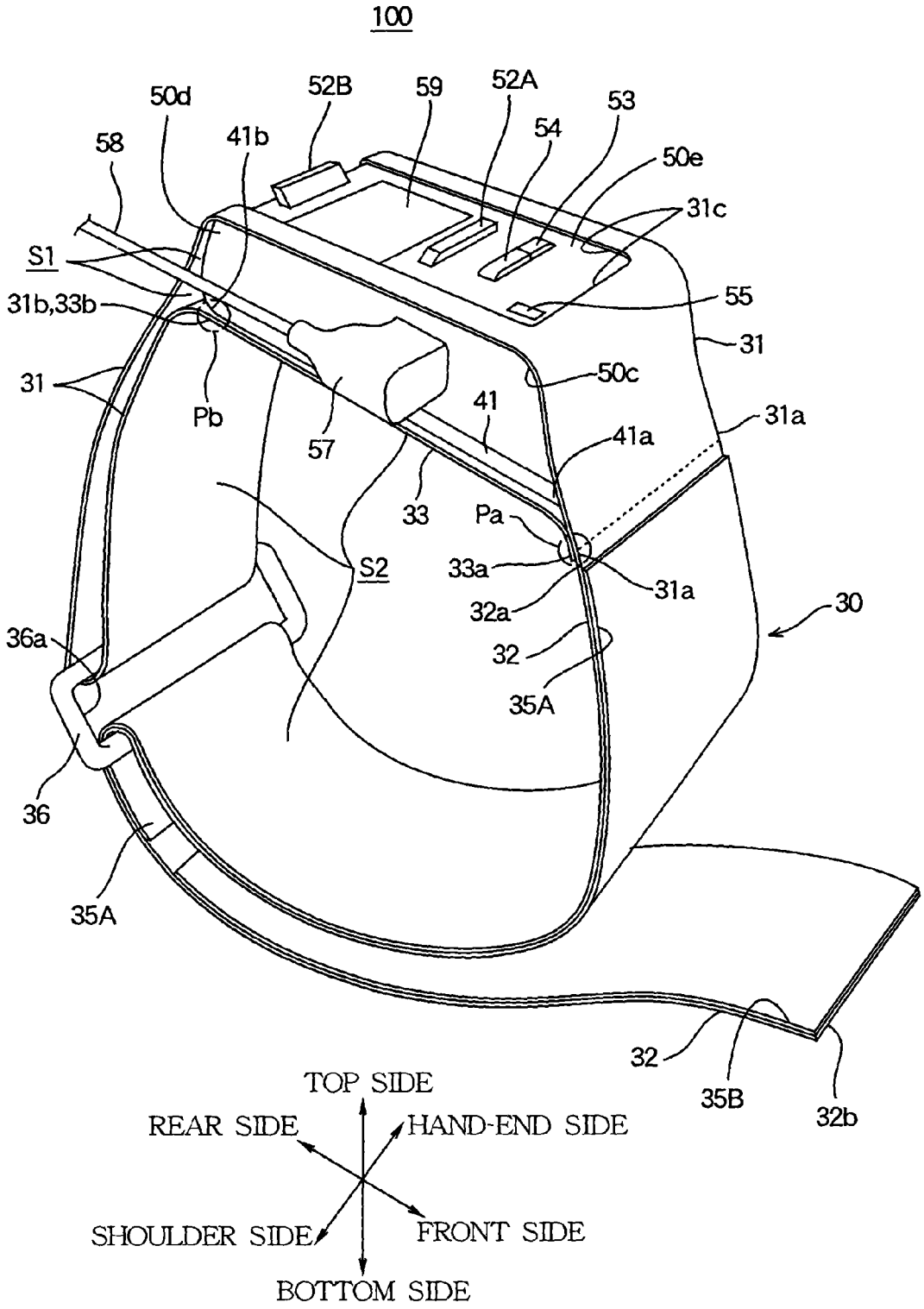
FIG. 2 is an outline view of the wearable electronic device.

FIG. 2 is an outline view of the wearable electronic device 100. The music playing device 40 includes a display screen 59 and a power supply switch 55. The music playing device 40 has a cord 58 extending from an attached headphone plug 57. A played music can be heard through the cord 58 with a headphone 28 (see FIG. 1(*a*)).

Although the description is given in detail later, the wearable electronic device 100 is adapted such that an attaching belt 30 is wound around the arm 25, primarily near an upper arm, and is attached to the arm 25 of the user 24. At that time, the arm 25 is positioned within an annular attaching portion S2 formed by the attaching belt 30. It is assumed that the arm 25 to which the wearable electronic device 100 is attached is a left arm. FIG. 2 shows an appearance which is viewed from a viewpoint of the user 24. That is, a front left side in FIG. 2 of the annular attaching portion S2 is a root direction of the arm 25. A direction of the music playing device 40 changes constantly according to movement of the arm 25, and thus, hereinafter, names of the direction are specified.

As shown in FIG. 2, a side on which the display screen 59 is provided is referred to as a "top side", and a side which faces the arm 25 is referred to as a "bottom side". With respect to side surfaces, a surface on a side to which the headphone plug 57 is attached faces a shoulder direction of the arm 25 of the user 24, and thus, a side of this surface is referred to as a "shoulder side", and a side opposite thereto is referred to as a "hand-end side". Further, it is assumed that the music playing device 40 is normally attached such that the display screen 59 faces a left direction. Thus, with respect to a lengthwise direction (circumferential direction of the arm 25) of the music playing device 40, a side on which the power supply switch 55 of the music playing device 40 is provided is referred to as a "front side" and a side opposite thereto is referred to as a "rear side".

Figure 3:
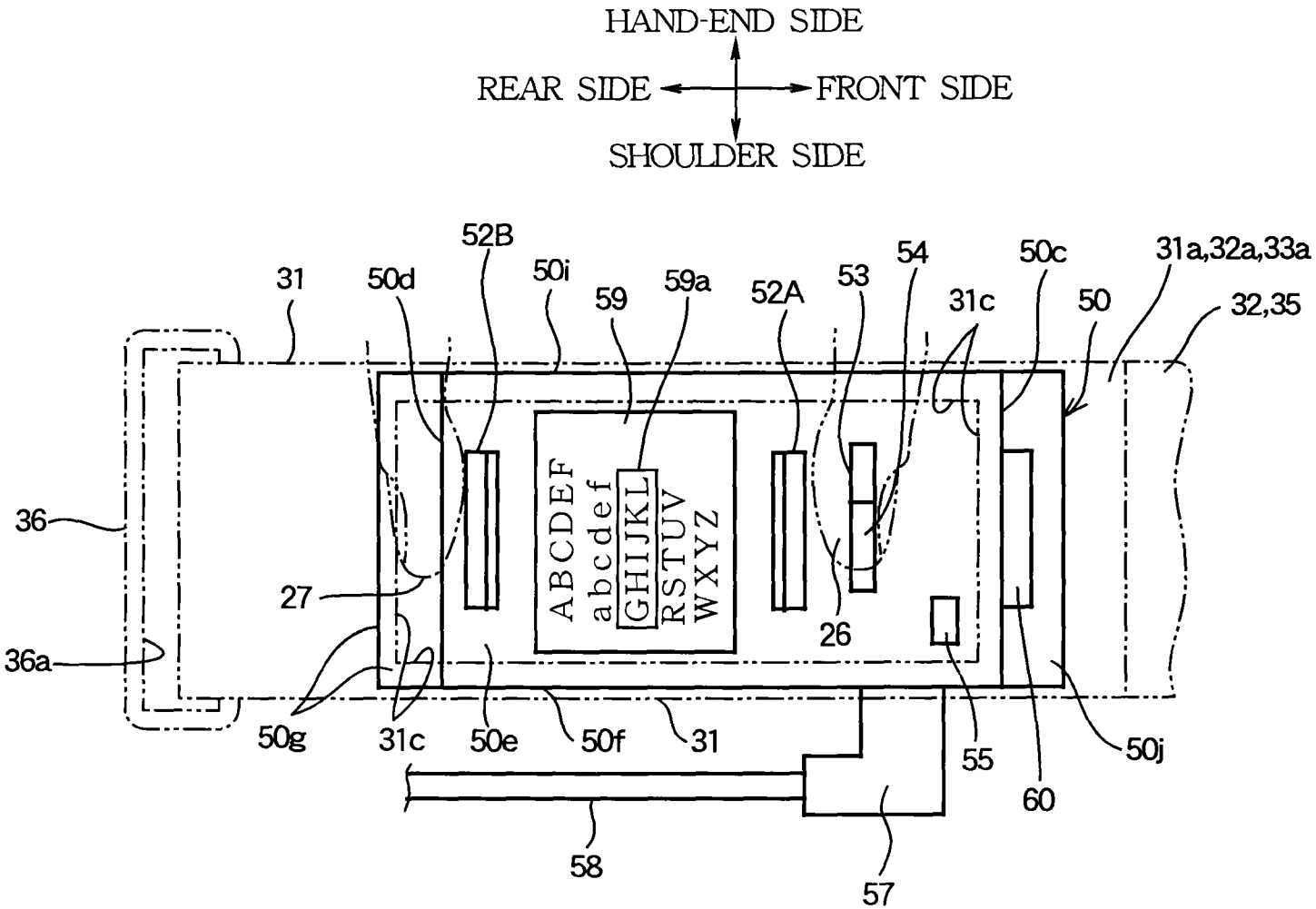
FIG. 3 is a diagram in which the music playing device is viewed from a top side.
Figure 4:
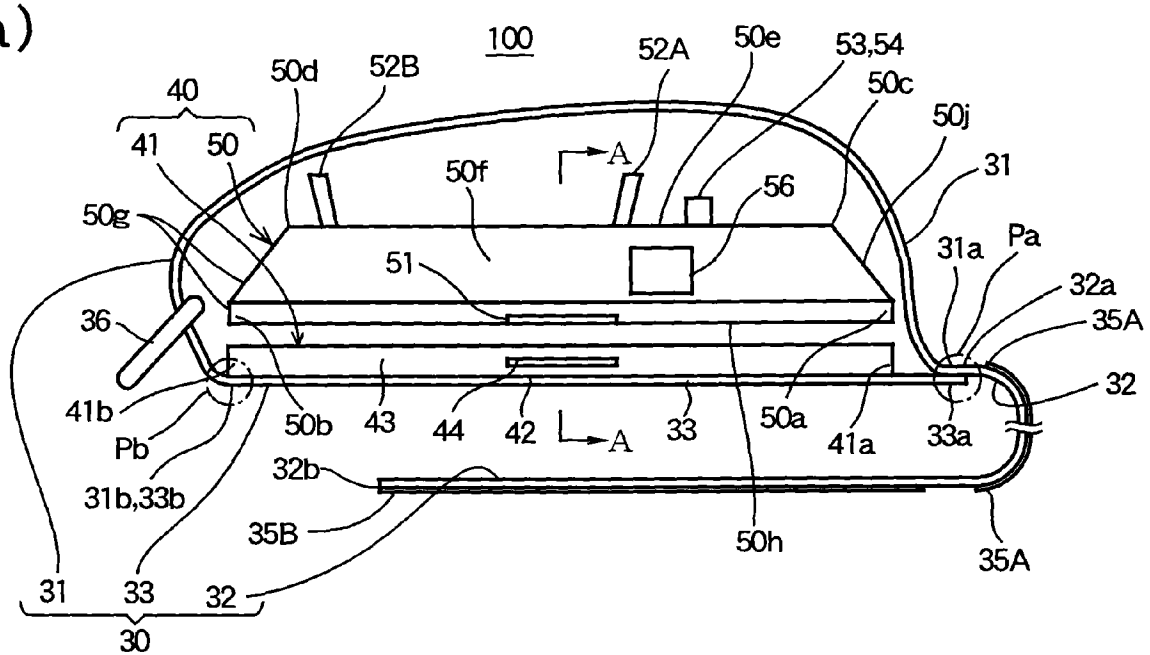
FIG. 4(*a*) is a diagram in which the wearable electronic device in a non-attaching state is viewed from a shoulder side.
Figure 4:
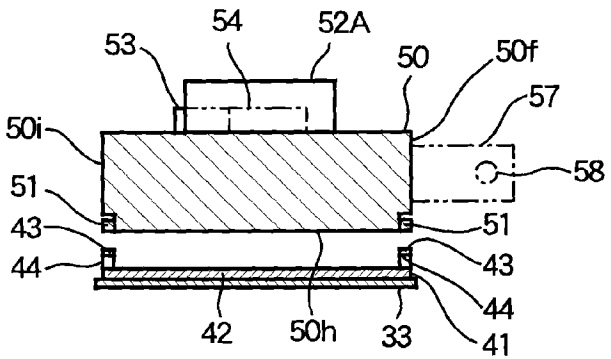
Figure 5:
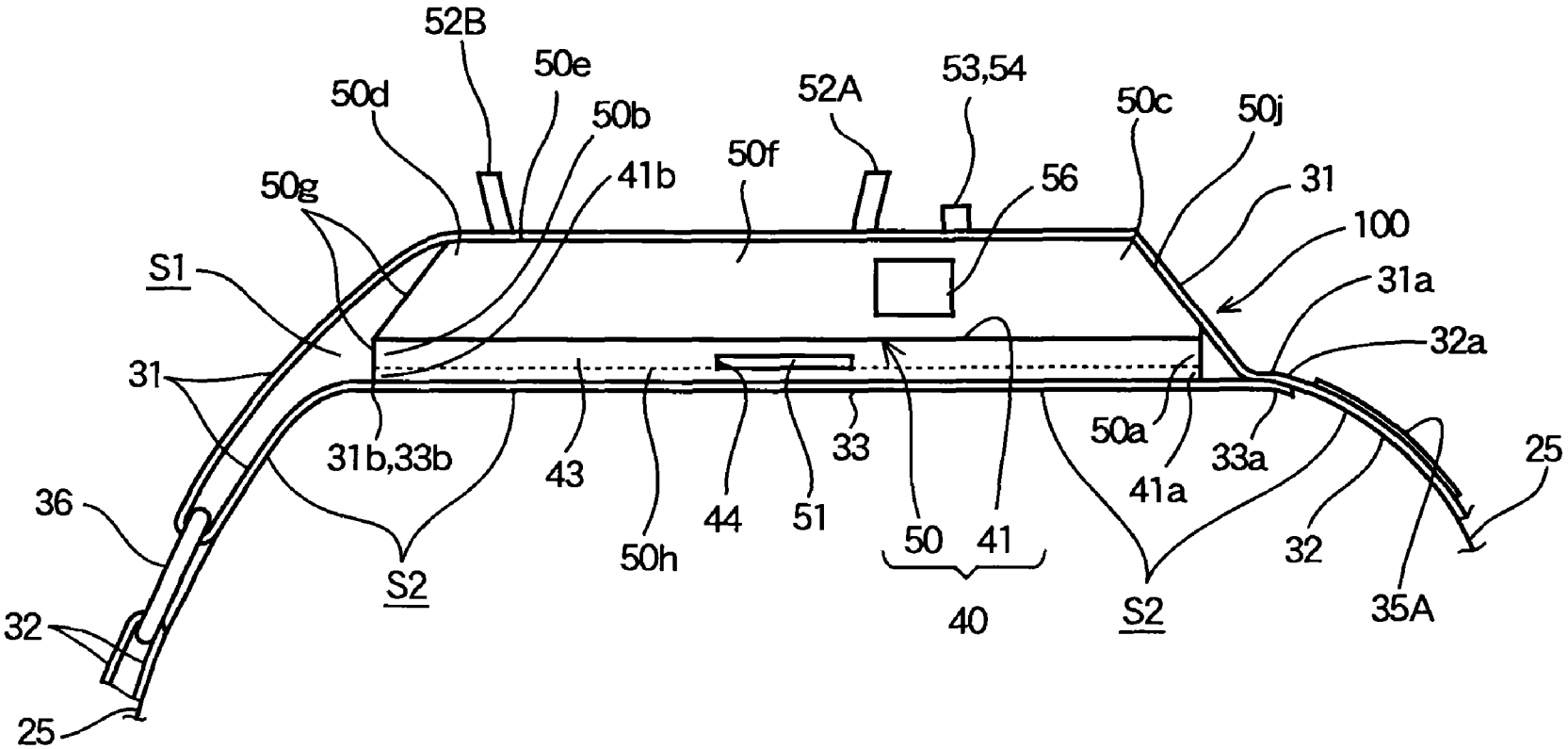
FIG. 5 is a diagram in which the wearable electronic device in an attached state is viewed from the shoulder side.

FIG. 3 is a diagram in which the music playing device 40 is viewed from the top side. FIG. 4(*a*) is a diagram in which the wearable electronic device 100 in a non-attached state is viewed from the shoulder side. FIG. 4(*b*) is a cross-sectional view along the line A-A of FIG. 4(*a*). FIG. 5 is a diagram in which the wearable electronic device 100 in an attached state is viewed from the shoulder side.

As shown in FIG. 4 and FIG. 5, the music playing device 40 is configured by a music playing device main body (hereinafter, briefly referred to as a "device main body") 50 and a base 41 separate from the device main body 50. A side surface 50*f* on the shoulder side of the device main body 50 is formed with a terminal 56. The above-described headphone plug 57 is inserted into the terminal 56 (see FIG. 2 and FIG. 3). As shown in FIG. 3, a front side surface 50*j* of the device main body 50 is formed with a terminal 60. The terminal 60 corresponds to a USB terminal which is one example of the communication interface 15.

The acceleration sensor 21, the ROM 12, the RAM 13, the recording device 14, the timer 16, the tone generator 19, and the sound system 20 (see FIG. 1(*b*)) are contained in the device main body 50. The display 18 includes the above-described display screen 59. The display screen 59 is configured by a liquid crystal display (LCD) or the like, and displays various pieces of information. The device main body 50 is formed with a heart-beat-sensor connecting terminal not shown. Through a heart-beat-sensor cord, not shown, connected thereto, a signal indicating a heart beat detected by the heart beat sensor 22 is supplied to the device main body 50. The controls group 23 includes not only the above-described power supply switch 55 but also first and second levers 52A and 52B, which are tilting switches, and a press switch 53 (see FIG. 2 and FIG. 3).

As shown in FIG. 4 and FIG. 5, the base 41 is configured integrally by a bottom plate portion 42 and side plate portions 43 on the shoulder side and the hand-end side, and is formed in a square bracket shape. A top thereof is opened as viewed from the rear side (see FIG. 4(*b*)). Near a center of the lengthwise direction, both of the side plate portions 43 are formed with locking slits 44.

As shown in FIG. 4(*b*), the device main body 50 is formed in a square shape, and a width thereof is approximately the same as that of the base 41, as viewed from the rear side, and is formed in an approximately trapezoidal shape as viewed from the shoulder side. An attaching surface 50*h*, which is the bottom surface of the device main body 50, and the base 41 are the same in length in a lengthwise direction. At bottom-side (attaching surface 50*h* side), narrow width portions of the side surface 50*f* on the shoulder side of the device main body 50 and of the side surface 50*i* on the hand-end side thereof are dimensioned to fit between both of the side plate portions 43 of the base 41. The narrow width portions are formed integrally with locking pieces 51 in a shape fitted into the locking slits 44 of the base 41.

When the narrow width portions of the device main body 50 are fitted between both of the side plate portions 43 of the based 41 to bring the attaching surface 50*h* into contact with the bottom plate portion 42, the locking pieces 51 are fitted into the locking slits 44. Thereby, the device main body 50 is secured to the base 41. On the other hand, when the device main body 50 is moved in a removal to a top side direction to cancel the fitting between the locking slits 44 and the locking pieces 51, the device main body 50 is extracted from the base 41. As described later, the base 41 is firmly secured to the attaching belt 30, and thus, these operations permit attaching and detaching of the device main body 50 to and from the attaching belt 30.

In a state where the device main body 50 is secured to the base 41, a front-side end 41*a* of the base 41 and a rear-side end 41*b* thereof are in contact with and secured to a front-side end 50*a* on a side of the attaching surface 50*h* of the device main body 50 and a rear-side end 50*b* thereof, respectively, whereby one unit is formed.

As shown in FIG. 3, the power supply switch 55 is arranged on the front side and the shoulder side within a top face 50*e* of the device main body 50. To prevent an improper operation, the power supply switch 55 is not protruded from the top face 50*e* and is flush with the top face 50*e* in a non-operating state. The display screen 59 is arranged mainly from a center in the lengthwise direction to a rear-side half within the top face 50*e*. The first and second levers 52A and 52B and the press switch 53 are projected on the top face 50*e* of the device main body 50. The first and second levers 52A and 52B are arranged adjacently to the display screen 59 on the front side and the rear side of the display screen 59, respectively. The first and second levers 52A and 52B sandwich the display screen 59 to face each other.

The first and second levers 52A and 52B are projected to tilt obliquely forwardly and obliquely backwardly, respectively (see FIG. 4(*a*) and FIG. 5), and have a long planar shape in a width direction of the top face 50*e* (in a direction from the shoulder side to the hand-end side). When the first and second levers 52A and 52B are applied with an operation force to a side of the display screen 59, the both levers are adapted to tilt to the sides of the display screen 59 (until the both levers stand approximately vertically). This is the movement at the time the first and second levers 52A and 52B are operated. On the other hand, when the operation is canceled, the first and second levers 52A and 52B are biased by a spring or the like so as to incline toward directions opposite to the display screen 59 to return unassisted to the original rest position. The first and second levers 52A and 52B can be operated individually.

The inventive wearable electronic device 40 is composed of the main body 50, the display screen 59 disposed on the top face 50*e* of the main body 50, and the first and second controls 52A and 52B that are arranged adjacent to opposite sides of the display screen 59, respectively, and that project from the top face 50*e* of the main body 50. The first control 52A is configured to incline to a near side of the display screen 59 by an operation of the user and to return to a rest position away from the near side. The second control 52B is configured to incline to a near side of the display screen 59 by an operation of the user and to return to a rest position away from the near side. An operation of one of the first and second controls 52A and 52B or both of the first and second controls 52A and 52B enables setting of the device 50 using the display screen 59.

The press switch 53 is arranged adjacently to the front side of the first lever 52A. The press switch 53 is a press-down button. In a shoulder side direction of the press switch 53, a finger support pad 54 is projected consecutively to the press switch 53. The press switch 53 and the finger rest 54 are long in the width direction of the top face 50*e*. The both components are integrally formed in a rectangular shape as viewed from the top side. The both components are the same in projection height, and in terms of design, the both are visually recognized as if they were integral.

Namely, the wearable electronic device 40 includes the third control 53 disposed in the vicinity of one of the first and second controls 52A and 52B in opposed relation to the side of the display screen 59 relative to the one of the first and second controls 52A and 52B. The third control 53 is mounted on the top face 50*e* of the main body 50 in the form of a push button or press switch. The wearable electronic device 40 further includes the support pad 54 disposed in the vicinity of the one of the first and second controls 52A and 52B in opposed relation to the side of the display screen 59 relative to the one of the first and second controls 52A and 52B. The support pad 54 is arranged on the top face 50*e* of the main body 50 for supporting a finger which operates the one of the first and second controls 52A and 52B. The pushbutton 53 and the support pad 54 are arranged adjacently with each other at the same height from the top face 50*e* of the main body 50.

When the wearable electronic device 100 is operated in a state of being attached to the left arm 25, the wearable electronic device 100 is operated by a right hand. In this case, as shown in FIG. 3, when a thumb 26 rests on the finger rest 54 to be brought into contact with or close to the first lever 52A, and at the same time, an index finger 27 is brought into contact with or close to the second lever 52B, it becomes easy to operate.

Practically, a distance between the first and second levers 52A and 52B is set approximately equal to an interval between an index finger and a thumb of an average user in a natural operation-standby state. Since the thumb 26 rests on the finger rest pad 54, it is easy to move either to a pressing operation of the press switch 53 or a tilting operation of the first lever 52A. Further, it is also easy to tilt the second lever 52B by the index finger 27. It is also easy to simultaneously operate the first and second levers 52A and 52B in opposite directions by the thumb 26 and the index finger 27. In this manner, a single hand operation is facilitated. Further, the finger rest 54 serves a protection function for inhibiting the thumb 26 from unintentionally operating the press switch 53 and the first lever 52A when the thumb 26 is locked. As described, the first control 52A is operated by the thumb 26 of the user, and the push button 53 is also operated by the thumb 26 of the user. The first and second controls 52A and 52B are spaced apart from each other at a span in the order of 20 mm through 50 mm such that the first and second controls 52A and 52B are operated concurrently with the thumb 26 and the index finger 27 of the user. Typically, the span is set to about 30 mm. The display screen 59 displays a cursor 59*a* for use in the setting of the device wearable device, such that the cursor 59*a* moves on the display screen 59 in association with the operation of the first and second controls 52A and 52B by the thumb 26 and index finger 27 of the user.

A change of a display content or a setting content of the display screen 59 by an operation of the controls is described later in FIG. 6 and FIG. 7 again. Typical operations include a device setting with respect to playing music or the like using the display screen 59. One example is that when depressed, the press switch 53 functions as a switch for advancing a process or a screen display to a subsequent hierarchy process or to a different menu, and when kept on being depressed for predetermined seconds (two seconds, for example) or more, the press switch 53 functions, contrary to the above-described case, as a return switch for returning the one hierarchy of the processing. The first and second levers 52A and 52B are used for selecting items displayed on the display screen 59.

For example, as shown in FIG. 3, the press switch 53 is used to display names of music pieces, which are candidates for playing, on the display screen 59. A color of a music name 59*a* ("GHIJKL", for example) which is a current candidate is displayed in a highlighted manner. A highlighted or focused candidate music is moved rearwardly or backwardly at each tilting operation of either one of the first lever 52A or the second lever 52B. When the tilting operations of the first and second levers 52A and 52B are performed almost simultaneously, a music which is the candidate at that time is determined as a played music, and begins to play. When a mode is switched, a function of each switch changes, and thus, it becomes possible to operate not only a function related to playing music such as a change of a sound volume and a timbre, etc., but also a display related to a healthcare and fitness management, or a pronunciation process, etc.

The user 24 can not only operate the controls with his or her eyes, but also can determine a position of the thumb 26 based on a position of the finger rest 54, and further, a position of the index finger 27 is automatically determined so that it is possible to move to the operation standby state without a need of a visual confirmation. With respect to a simple operation such as a sound volume change, music skipping, or the like, it is possible to operate without a need of viewing the controls and the display screen 59.

Subsequently, a description is given of a configuration of the attaching belt 30 and related portions thereof. As shown in FIG. 4(*a*), the attaching belt 30 is configured by: a first belt portion 31; a second belt portion 32; a third belt portion 33; and a ring member 36. All the first to third belt portions 31 to 33 are made of resin or a flexible member such as a fabric, as a base material, and are configured to be in a band shape with the same widths.

The third belt portion 33 is secured with the bottom plate portion 42 of the base 41. A method of securing the third belt portion 33 to the base 41 is not limited. Detachable attachment may be possible. At least, it suffices that the front-side end 41*a* of the base 41 and the rear-side end 41*b* thereof substantially are stationary to a front-side first end 33*a* of the third belt portion 33 and a rear-side second end 33*b* thereof, respectively. A middle portion across the first end 33*a* and the second end 33*b* may not be secured to the based 41.

As shown in FIG. 2 and FIG. 4(*a*), a first end 31*a* of the first belt portion 31 and a first end 32*a* of the second belt portion 32 are in a secured state relative to the first end 33*a* of the third belt portion 33 at a joint point Pa. Further, a second end 31*b* of the first belt portion 31, as well as the second end 33*b* of the third belt portion 33, is in a secured state relative to the rear-side end 41*b* of the base 41 at a joint point Pb.

In reality, in the embodiment, the first to third belt portions 31 to 33 are formed integrally as one seamless band. The first end 33*a* is fastened to the first end 31*a* and the first end 32*a* at the joint point Pa. However, any one of or all of the first to third belt portions 31 to 33 may be configured as a separate body, and then, may be brought into a secured state as described above. When the first to third belt portions 31 to 33 are configured as a separate body, it suffices that the first ends 31*a*, 32*a*, and 33*a* are stationary to the front-side end 41*a* of the base 41 stationary to the front-side end 50*a* of the device main body 50. It suffices that the second ends 31*b* and 33*b* are stationary to the rear-side end 41*b* of the base 41 stationary to the rear-side end 50*b* of the device main body 50.

The first belt portion 31 covers the top face 50*e* of the device main body 50. A whole length from the first end 31*a* to the second end 31*b* is set to be longer than an outer dimension which extends from the front-side end 41*a* of the base 41, via the front-side surface 50*j* of the device main body 50, the top face 50*e* thereof, and the rear-side surface 50*g* thereof, to the rear-side end 41*b*. Between the first end 31*a* and the second end 31*b*, the ring member 36 is engaged. As shown in FIG. 3, the ring member 36 has a pass-through portion 36*a*. When the first belt portion 31 is passed through the pass-through portion 36*a* before the first end 33*a* is fastened to the first end 31*a* and the first end 32*a*, the ring member 36 is engaged with the first belt portion 31.

As shown in FIG. 2 and FIG. 3, the first belt portion 31 is formed with a window portion 31*c*. In a state where the wearable electronic device 100 is attached, constituent elements of the display screen 59 and the controls group 23 (which includes the first and second levers 52A and 52B, the press switch 53, etc.) on the top surface 50*e* are exposed from the window portion 31*c*. Therefore, there is no problem in the operation or the visual recognition of the controls group 23. When the first end 31*a* of the first belt portion 31 is stationary to the front-side end 41*a* of the base 41, a positioning function is obtained for positioning the window portion 31*c* in an appropriate position in the top surface 50*e*.

When the wearable electronic device 100 is attached to the arm 25, the second end 32*b* of the second belt portion 32 is passed through the pass-through portion 36*a* of the ring member 36 and then folded back on a bottom side (side of the attaching surface 50*h*) of the device main body 50, as shown in FIG. 2. Out of the second belt portion 32, a surface of respectively facing sides formed as a result of folding back is formed with a pair of hook-and-loop fasteners 35A and 35B which are fastened and so on (see FIG. 2, FIG. 4(*a*), and FIG. 5). Mating of the two hook-and-loop fasteners 35A and 35B stably secures the second belt portion 32 in a folded-back state. The hook-and-loop fasteners 35A and 35B may be any means as long as they can repeatedly fasten/separate each other. A configuration thereof is not limited.

In a state where the wearable electronic device 100 is attached to the arm 25, as shown in FIG. 2 and FIG. 5, the annular attaching portion S2 is formed by: a portion, out of the first belt portion 31, from the second end 31*b* to the ring member 36; the third belt portion 33 (through the attaching surface 50*h* of the device main body 50); and a portion, out of the second belt portion 32, from the first end 32*a* to the ring member 36. In a specific attaching task, the second belt portion 32 is wound around the arm 25, and the second end 32*b* is passed through the ring member 36 and then folded back. The second end 32*b* is pulled such that an appropriate tightening strength is achieved, and thereafter, the hook-and-loop fasteners 35A a 35B are mated each other for fixation. Thereby, a peripheral area of the arm 25 is wound by the annular attaching portion S2. The device main body 50 is protected from an outer force, and dropping off also is inhibited. In addition, the outer appearance is improved.

In this attaching state, the first belt portion 31 closely contacts the front-side surface 50*j* of the device main body 50, the front-side end 50*c* on a side of the top face 50*e* of the device main body 50, and the top face 50*e* (see FIG. 5). Between the rear-side surface 50*g* of the device main body 50 and an overlapped portion of the first belt portion 31, an annular portion S1 is formed. The annular portion S1 is formed in a triangular shape which links the rear-side end 50*d* and the rear-side end 50*b* on the side of the top face 50*e* of the device main body 50, and the ring member 36. When the device main body 50 receives the outer force from the rear end side, the annular portion S1 serves a cushioning function for absorbing the outer force.

Figure 6:
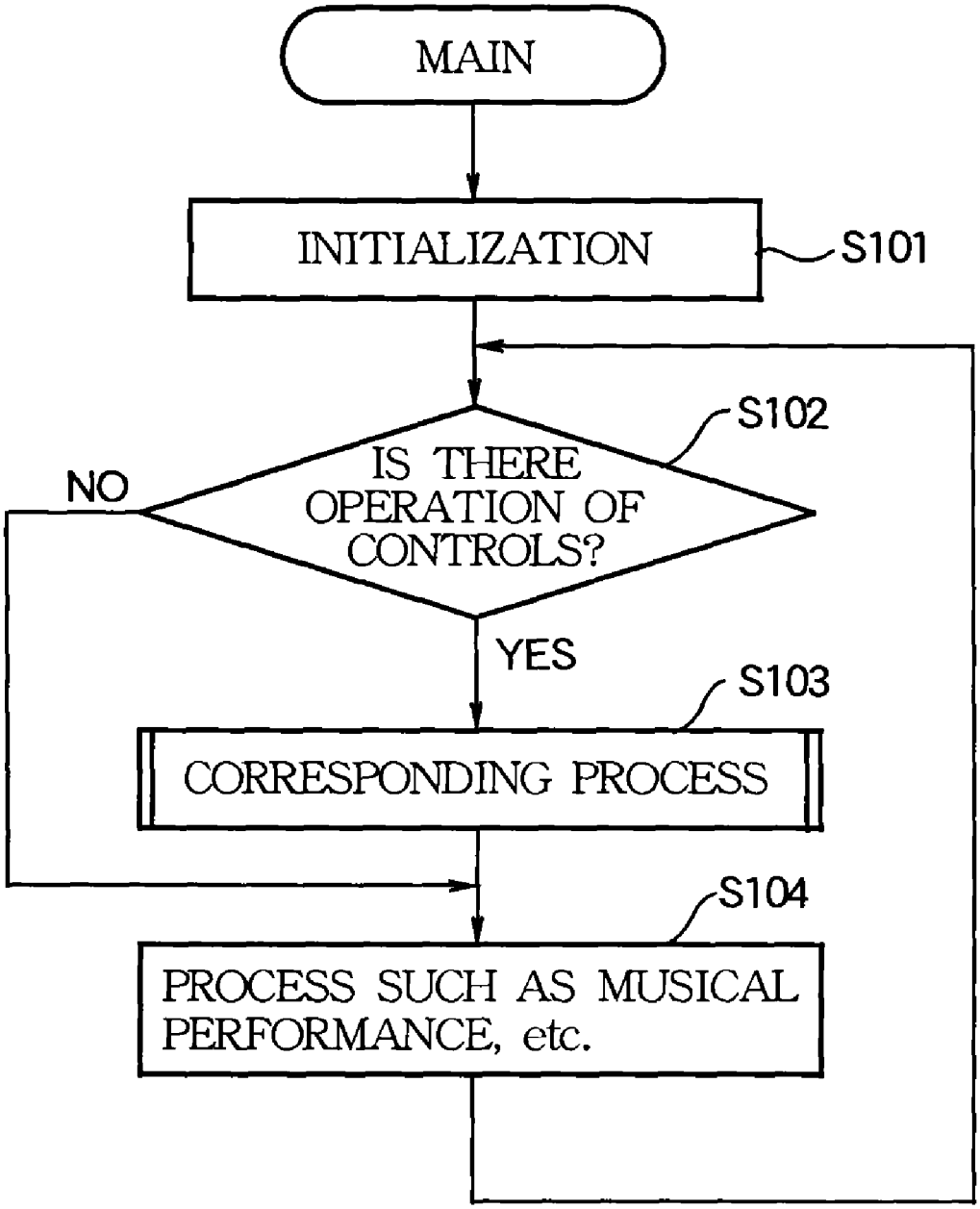
FIG. 6 is a flowchart of a main process.

FIG. 6 is a flowchart of a main process. The process is started by turning on the power supply switch 55, and is executed by the CPU 11.

Firstly, an initialization is executed, that is, an execution of a predetermined program is begun, and initial values are set to various registers to perform initial settings (step S101). Subsequently, an operation of any control in the controls group 23 is detected (step S102). Only when there is the operation, a corresponding process described later in FIG. 7 is executed (step S103). Thereafter, a process such as a musical performance is executed (step S104), and the process returns to the step S102. In the process such as a musical performance, when a music playing mode is selected, a playing process of a selected music is performed. The wearable electronic device 40 contains the tone generator 19 for generating tones of a music piece. The first and second controls 52A and 52B are operated to select and set the music piece in the tone generator 19. In other modes, a process according to a mode (display or the like in the healthcare and fitness management) is executed.

FIG. 7 is a flowchart of the corresponding process executed at the step S103 in FIG. 6. Firstly, when there is an operation of the first lever 52A, an item in a selected or focused state on the display screen 59 (see FIG. 3) is moved to a side of the second lever 52B (rear side) (step S201→S202→S204). However, when there is an operation of the second lever 52B within t seconds (0.5 seconds, for example) from the operation of the first lever 52A, it is determined that a simultaneous operation of the both levers 52A and 52B is intended, and thus, an item in a current selected state is set to the device (step S201→S202→S203).

The same applies to a case where the second lever 52B is firstly operated. In the case of a single operation of the second lever 52B, an item in a selected of focused state is moved to a side of the first lever 52A (front side) (step S205→S206→S208). However, in the case of the simultaneous operation of the both levers 52A and 52B, an item in a current selected state is set to the device (step S205→S206→S207).

In the case of a mode where a music selection is performed, a music piece set at the steps S203 and S207 is played at the step S104 in FIG. 6. The display screen 59 displays a list of items to be selected for the setting, the first control 52A is operated to shift the focus on the items in one direction of the list for selection, and the second control 52B is operated to shift the focus on the items in another direction of the list for selection. The first and second controls 52A and 52B are operated separately from each other to input the setting, and the first and second controls 52A and 52B are operated simultaneously with each other to effectuate the inputted setting in the main body 50, so that the main body 50 effectuates the reproduction of the music piece which is specified by the inputted setting.

At step S209, when there is a "return switch operation", that is, when the press switch 53 is pressed consecutively for predetermined seconds or more, a display on the display screen 59 or a process content is returned to the last display of menus or last hierarchy of the processing (steps S209 and S210). On the other hand, in the case of an "advance switch operation" in which the press switch 53 is pressed within predetermined seconds, the display on the display screen 59 or the process content is advanced to a subsequent display or hierarchy (steps S211 and S212).

Subsequently, other process is executed (step S213), and the process is ended. Herein, in the other process, for example, a process such as turning off of the power supply switch 55, a mode switching, etc., is executed. The mode switching is performed by a predetermined combination of operations of the first and second levers 52A and 52B and the press switch 53.

According to the embodiment, when the second belt portion 32 is passed through the pass-through portion 36*a* of the ring member 36 and then folded back, the annular attaching portion S2 is formed, and thereby, the wearable electronic device 100 is easily attached to the arm 25 (see FIG. 2 and FIG. 5). In particular, since the annular portion S1 is formed on the rear-end side by the rear-side surface 50*g* of the device main body 50 and the first belt portion 31, a shock from the rear-end side of the device main body 50 is absorbed by the annular portion S1. As a result, the device main body 50 can be effectively protected from the outer force from outside.

When the second belt portion 32 is tightened, the first belt portion 31 results in being pressed strongly from the top side of the device main body 50, and thus, the device main body 50 is not easily dropped. On the other hand, when the second belt portion 32 is loosened, a gap is formed between the first belt portion 31 and the device main body 50, and thus, it becomes easy to remove the device main body 50 from the base 41. Further, the attaching belt 30 can be configured of a single band, and there is no need of providing a holding portion in a bag shape, etc. Thus, the configuration is simple. Therefore, the configuration of the attaching belt 30 is simple, but it becomes possible to inhibit dropping of the device main body 50 due to the outer force and to facilitate a task of attaching and detaching the device main body 50. Further, the outer appearance can be improved as compared to a configuration where the device main body 50 is projected and exposed.

According to the embodiment, by the operation of the first and second levers 52A and 52B arranged in a projecting manner in positions to sandwich the display screen 59 and to face each other, the device setting using the display screen 59 can be performed. Thus, it becomes possible to facilitate a setting operation using a screen display.

Since the finger rest pad 54 is arranged consecutively to the press switch 53, it becomes easy to determine a standby position of a finger before operation, thereby further facilitating the operation. Further, when the device setting using the display screen 59 is performed in a state where the thumb 26 rests on the finger rest pad 54, only a small displacement amount of the thumb 26 for operating the first lever 52A from the finger rest pad 54 is required, and the simultaneous operations are possible arbitrarily in a state where a weight center of the thumb 26 rests on the finger rest pad 54, whereby setting operation can be performed very smoothly.

Figure 8:
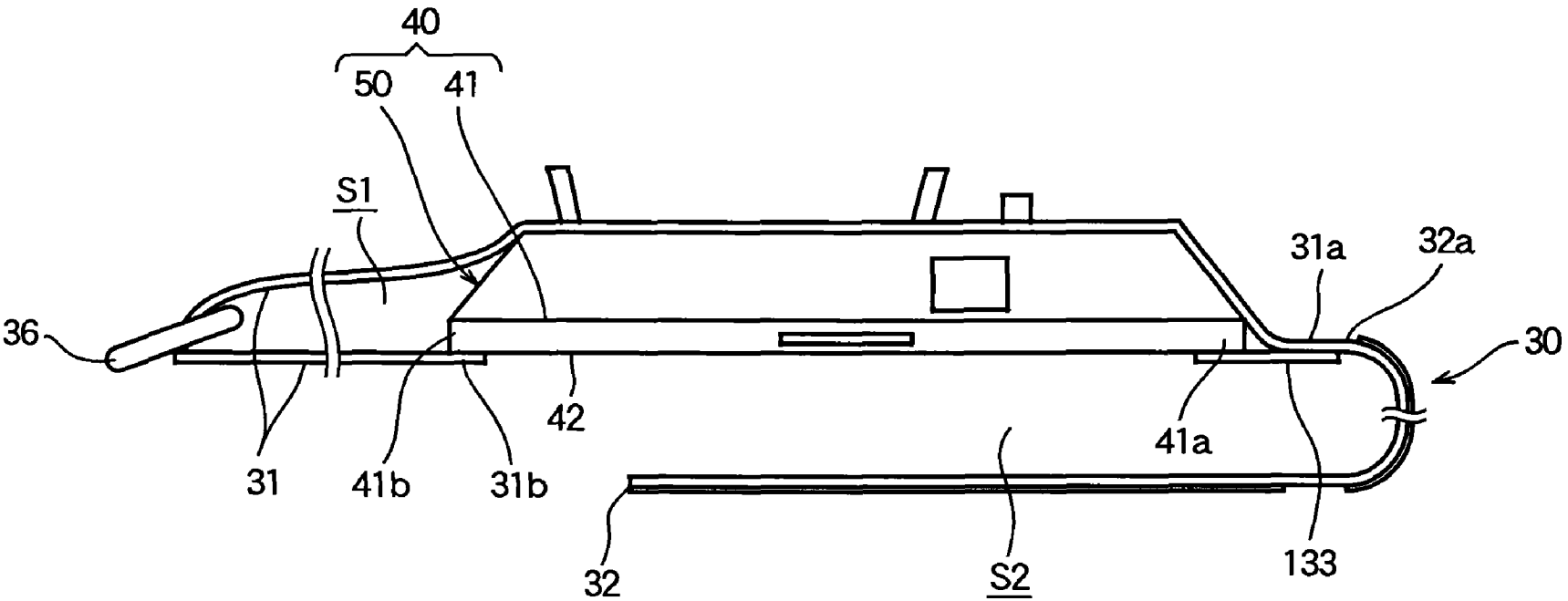
FIG. 8 is a diagram of a wearable electronic device in which an attaching belt of an alternate embodiment is illustrated as viewed from the shoulder side.

FIG. 8 is a diagram of a wearable electronic device in which an attaching belt of an alternate embodiment is adopted, as viewed from the shoulder side. In the attaching belt 30 according to the alternate embodiment, the third belt portion 33 is abolished from the configuration shown in FIG. 1 to FIG. 5 and a connecting portion 133 is arranged instead thereof. The rest of the configuration is completely the same.

That is, the second end 31*b* of the first belt portion 31 is secured to the rear-side end 41*b* of the base 41 stationary to the rear-side end 50*b* of the device main body 50. The first ends 31*a* and 32*a* of the first and second belt portions 31 and 32 are secured through the connecting portion 133 to the front-side end 41*a* of the base 41 stationary to the front-side end 50*a* of the device main body 50.

In the configuration, there is no third belt portion 33, and thus, in a state where the wearable electronic device 100 is attached to the arm 25, the bottom plate portion 42 of the base 41 forms part of the annular attaching portion S2 (see FIG. 2 and FIG. 5), resulting in a direct contact with the arm 25. The formation of the annular portion S1 is similarly found in the example of FIG. 1 to FIG. 5. Therefore, also in the alternate embodiment, an effect similar to that in the configuration of FIG. 1 to FIG. 5 can be provided.

In the embodiment, there is illustrated a configuration such that the device main body 50 is secured via the base 41 to the attaching belt 30. However, when an effect of making the device main body 50 detachable from the attaching belt 30 is not necessary, a configuration such that the music playing device 40 is directly secured to the attaching belt 30 may be adopted.

It is noted that the pass-through portion 36*a* (see FIG. 3) of the ring member 36 may not be completely annular, and may be configured such that a cutaway is provided in one portion to be detachable from the first belt portion 31.

The rear-side surface 50*g* and the front-side surface 50*j* of the device main body 50 (see FIG. 4(*a*)) may not be an inclined plane, and may be a vertical plane to the top face 50*e*.

The device setting caused by operations of the first and second levers 52A and 52B is described above, but it is merely one example. For example, it may be configured such that only one of the first and second levers 52A and 52B is operated to enable the device setting. Alternatively, it may also be possible to configure to change a content settable by a single lever or a combination of levers. An assigning function to each control may be changed by a mode. As a result, a variety of settings can be facilitated.

A direction into which the arm 25 is passed through the attaching belt 30 may be opposite to that illustrated. Further, a securing direction of the attaching belt 30 relative to the music playing device 40 in a lengthwise direction of the music playing device 40 may be opposite to that illustrated.

The disclosed embodiment is a wearable electronic device attachable to an arm of the user such as a wearable music player. However, the invention is not limited to the wearable electronic device, but may be applied to any type of electronic apparatuses using manual controls for the setting operation or other operation.

The invention claimed is:

1. An apparatus comprising:

a main body;

first and second controls that project from a face of the main body, the first control projecting from the face at a first direction of inclination, and the second control projecting from the face at a second direction of inclination; and a display screen disposed on the face of the main body, wherein the first control is arranged adjacent to a first side of the display screen, and the second control is arranged adjacent to a second side of the display screen, the first and second sides being arranged opposite to each other, wherein the first control is configured to move toward the second control by a first user operation from a first rest position and automatically return to the first rest position, which is away from the second control, when released from the first user operation, wherein the second control is configured to move toward the first control by a second user operation from a second rest position and automatically return to the second rest position, which is away from the first control, when released from the second user operation, wherein the first and second controls are configured to manipulate setting items of the apparatus displayable on the display screen by operating either the first or second control or both the first and second controls, wherein the first and second controls are operable independently of each other to select an item of the setting items displayable on the display screen, and the first and second controls are concurrently operable together to set the selected item.

2. The apparatus according to claim 1, wherein the main body is attachable to an arm of a user.

3. The apparatus according to claim 1, wherein the display screen displays a list of setting items to be selected to set the apparatus, the first control is operable to shift a focus on the setting items in one direction of the list for selection, and the second control is operable to shift a focus on the setting items in another direction of the list for selection.

4. The apparatus according to claim 1, further comprising a tone generator for generating tones of a music piece, wherein the first and second controls are operated to select and set the music piece in the tone generator.

5. The apparatus according to claim 1, further comprising a third control disposed on the face of the main body in the vicinity of one of the first or second control in opposed relation to one of the first or second side of the display screen relative to the one of the first or second control.

6. The apparatus according to claim 5, wherein the third control is mounted on the face of the main body in the form of a push button.

7. The apparatus according to claim 5, further comprising a support pad disposed in the vicinity of the one of the first or second control in opposed relation to the one of the first or second side of the display screen relative to the one of the first or second control, the support pad being arranged on the face of the main body and configured to support a finger that operates the one of the first or second control.

8. The apparatus according to claim 7, wherein the third control and the support pad are arranged adjacently with each other at the same height from the face of the main body.

9. The apparatus according to claim 5, wherein the one of the first or second controls is configured to be operable by a thumb of the user, and the third control is also configured to be operable by the thumb of the user.

10. The apparatus according to claim 1, wherein the first and second controls are spaced apart from each other at a span in the order of 20 mm through 50 mm to enable the first and second controls to be operable concurrently with a thumb and an index finger of the user.

11. The apparatus according to claim 10, wherein the display screen displays a cursor for use in setting the apparatus, the cursor being movable on the display screen in association with the operation of the first and second controls by the thumb and index finger of the user.

* * * * *